US007607589B2

(12) United States Patent
Yu et al.

(10) Patent No.: US 7,607,589 B2
(45) Date of Patent: Oct. 27, 2009

(54) DROPLET GENERATION APPARATUS

(75) Inventors: Shan-Yi Yu, Jhonghe (TW); Han-Chang Liu, Jhonghe (TW); Wen-Yu Tsai, Jhonghe (TW)

(73) Assignee: Health & Life Co., Ltd., Taipei (TW)

( * ) Notice: Subject to any disclaimer, the term of this patent is extended or adjusted under 35 U.S.C. 154(b) by 300 days.

(21) Appl. No.: 11/599,316

(22) Filed: Nov. 15, 2006

(65) Prior Publication Data

US 2008/0111003 A1 May 15, 2008

(51) Int. Cl.
*B05B 1/08* (2006.01)

(52) U.S. Cl. ..... 239/102.2; 239/397.5; 239/552; 239/556; 239/596; 239/601

(58) Field of Classification Search ..... 239/102.1, 239/102.2, 397.5, 548, 552, 556, 596, 600, 239/601

See application file for complete search history.

(56) References Cited

U.S. PATENT DOCUMENTS 4,530,464 A * 7/1985 Yamamoto et al. ..... 239/102.2
4,605,167 A * 8/1986 Maehara ..... 239/102.2
6,394,363 B1 * 5/2002 Arnott et al. ..... 239/102.1
6,915,962 B2 * 7/2005 Power et al. ..... 239/102.2
7,168,633 B2 * 1/2007 Wang et al. ..... 239/102.2

* cited by examiner

*Primary Examiner*—Steven J Ganey
(74) *Attorney, Agent, or Firm*—Rosenberg, Klein & Lee

(57) ABSTRACT

A droplet generation apparatus is applied to a nebulizer. The droplet generation apparatus comprises a vibratable member, a nozzle disc, a housing and a connection member or a fastening plate or both the connection member and the fastening plate. The vibratable member has a first through hole. The nozzle disc has a plurality of apertures facing the first through hole, and is combined with the vibratable member. The connection member is disposed between the vibratable member and the nozzle disc, and has a second through hole corresponding to the first through hole. Alternatively, the fastening plate is combined with the nozzle disc. The housing covers up the combination of the vibratable member, the nozzle disc and the connection member or the fastening plate. Vibration efficiency generated by the vibratable member is improved through the connection member. An accommodation space is formed by the fastening plate and the nozzle disc.

30 Claims, 8 Drawing Sheets

DROPLET GENERATION APPARATUS

FIELD OF THE INVENTION

The present invention generally relates to a droplet generation apparatus, and more specifically relates to the droplet generation apparatus that improves the droplet generation efficiency.

BACKGROUND OF THE INVENTION

An atomizer used in the current market is usually composed of a vibratable element made by a piezoelectric material and a nozzle disc, wherein the vibratable element is disposed in a chamber which is used to accommodate liquid, or connected to the nozzle disc. High speed reciprocating motion then is generated when the piezoelectric material is conducted electricity so that liquid can pass through the nozzle disc. Alternatively, the nozzle disc is driven to generate vibration so that liquid then is squeezed to be sprayed from the nozzle disc. Moreover, liquid is sprayed from micro-apertures of the nozzle disc to become micro droplets to achieve the goal of nebulizing liquid.

Referring to FIG. 1 for the assembly cross-section drawing of a conventional micro-droplet generating device is illustrated. The micro-droplet generating device 1 has a nozzle disc 11 and a vibratable element 12. The nozzle disc 11 has micro-apertures 111, and a certain interval is maintained between the vibratable element 12 and the nozzle disc 11. Reciprocating motion then is generated by driving the vibratable element 12 to squeeze liquid to be sprayed from the apertures 111 of the nozzle disc 11, thereby forming micro-droplets.

However, the design must control the interval between the nozzle disc and the vibratable element to achieve the efficiency of spraying micro-droplets. The manufacture may not be easily implemented for the control. Therefore, the inventors of the present invention based on years of experience in the related field to conduct extensive researches and experiments, and finally invented a droplet generation apparatus as a method or a basis for overcoming the aforementioned problems.

SUMMARY OF THE INVENTION

A primary object of the present invention is to provide a droplet generation apparatus to improve the droplet generation efficiency.

To achieve the foregoing object, the droplet generation apparatus of the invention comprises a vibratable member, a connection member, a nozzle disc and a housing. The vibratable member has a first through hole. The nozzle disc has a plurality of apertures facing the first through hole. The connection member is disposed between the vibratable member and the nozzle disc, and has a second through hole corresponding to the first through hole. The housing covers up the vibratable member, the nozzle disc and the connection member. Vibration efficiency generated by the vibratable member then is improved through the connection member.

Moreover, the droplet generation apparatus of the invention comprises the vibratable member, the nozzle disc, the fastening plate and the housing, wherein the vibratable member has the first through hole, and is combined with the fastening plate. The nozzle disc is disposed between the vibratable member and the fastening plate, and has a plurality of apertures facing the first through hole. The housing covers up the vibratable member, the nozzle disc and the fastening plate. An accommodation space then is formed by the fastening plate and the nozzle disc.

Alternatively, the droplet generation apparatus of the invention comprises the vibratable member, the connection member, the nozzle disc, the fastening plate and the housing. The vibratable member has the first through hole. The nozzle disc has a plurality of apertures facing the first through hole. The connection member is disposed between the vibratable member and the nozzle disc, and has a second through hole corresponding to the first through hole. The fastening plate is combined to a plane of the nozzle disc. The housing covers up the vibratable member, the connection member, the nozzle disc and the fastening plate. The vibration efficiency generated by the vibratable member then is improved through the connection member, and an accommodation space is therefore formed by the fastening plate and the nozzle disc.

Accordingly, vibration efficiency of the droplet generation apparatus is increased by the connection member or the fastening plate or both the connection member and the fastening plate, and by using the housing as an o-shaped ring. The efficiency and accuracy of nubulizing fluid performed by the nozzle disc then is enhanced without controlling the interval.

To make it easier for our examiner to understand the object of the invention, its innovative features and performance, a detailed description and technical characteristics of the present invention are described together with the drawings as follows.

DETAILED DESCRIPTION OF THE PREFERRED EMBODIMENTS

Figure 1:
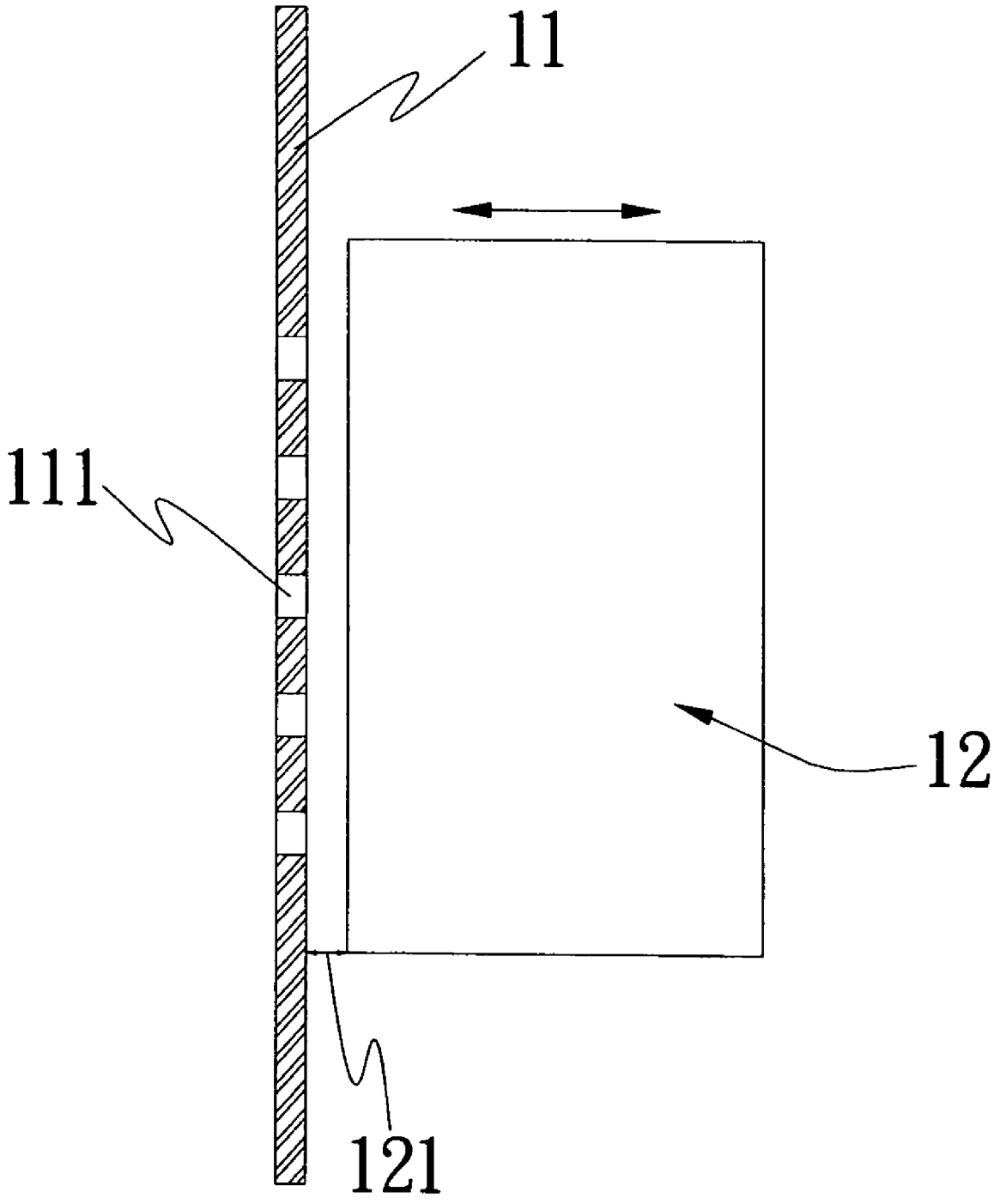
FIG. 1 is an assembly cross-section drawing of a conventional micro-droplet generating device.

Referring to the related figures for the droplet generation apparatus according to a preferred embodiment of the present invention, wherein the same elements are described by the same reference numerals.

Figure 2:
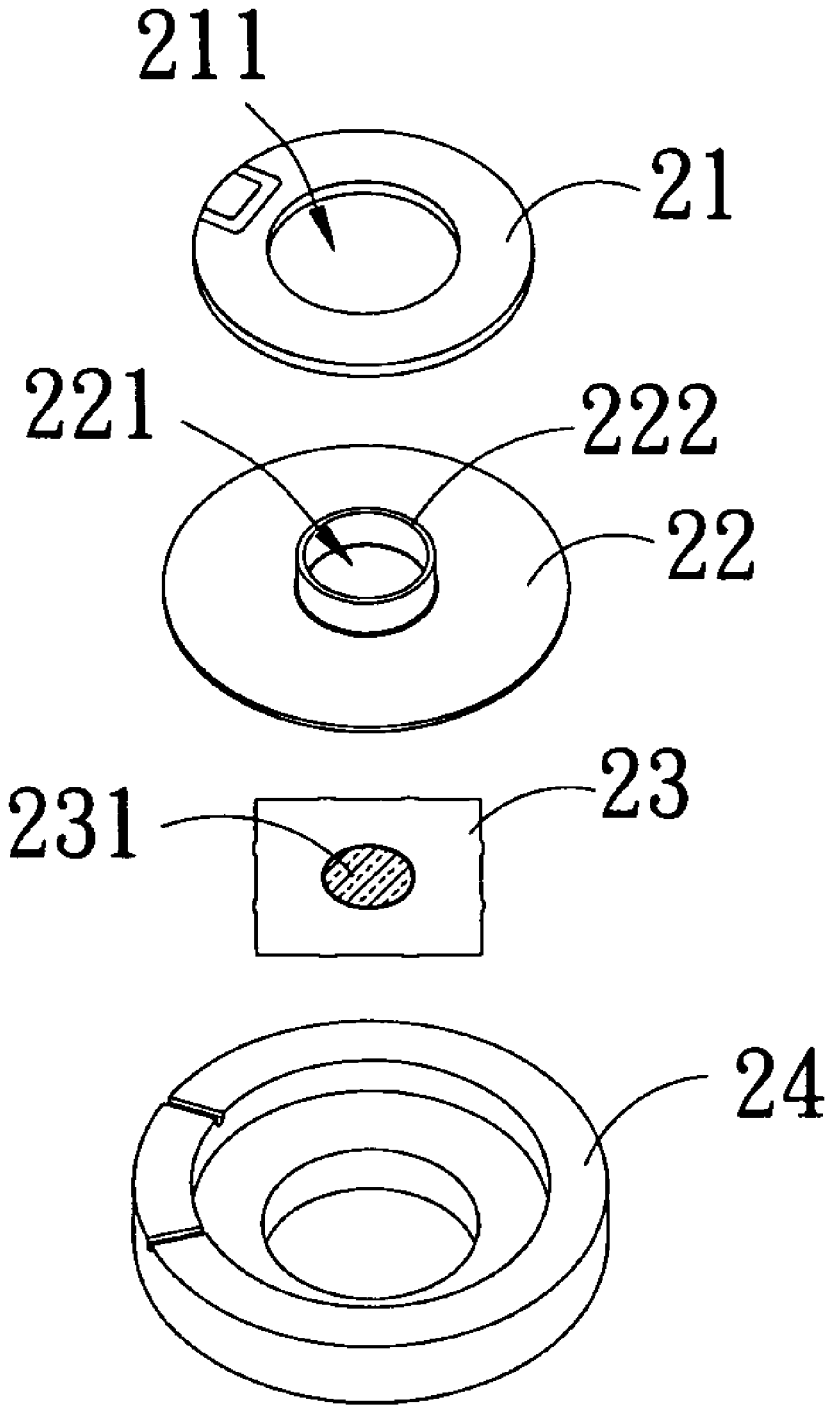
FIG. 2 is an exploded assembly drawing of a droplet generation apparatus of the present invention.
Figure 3:
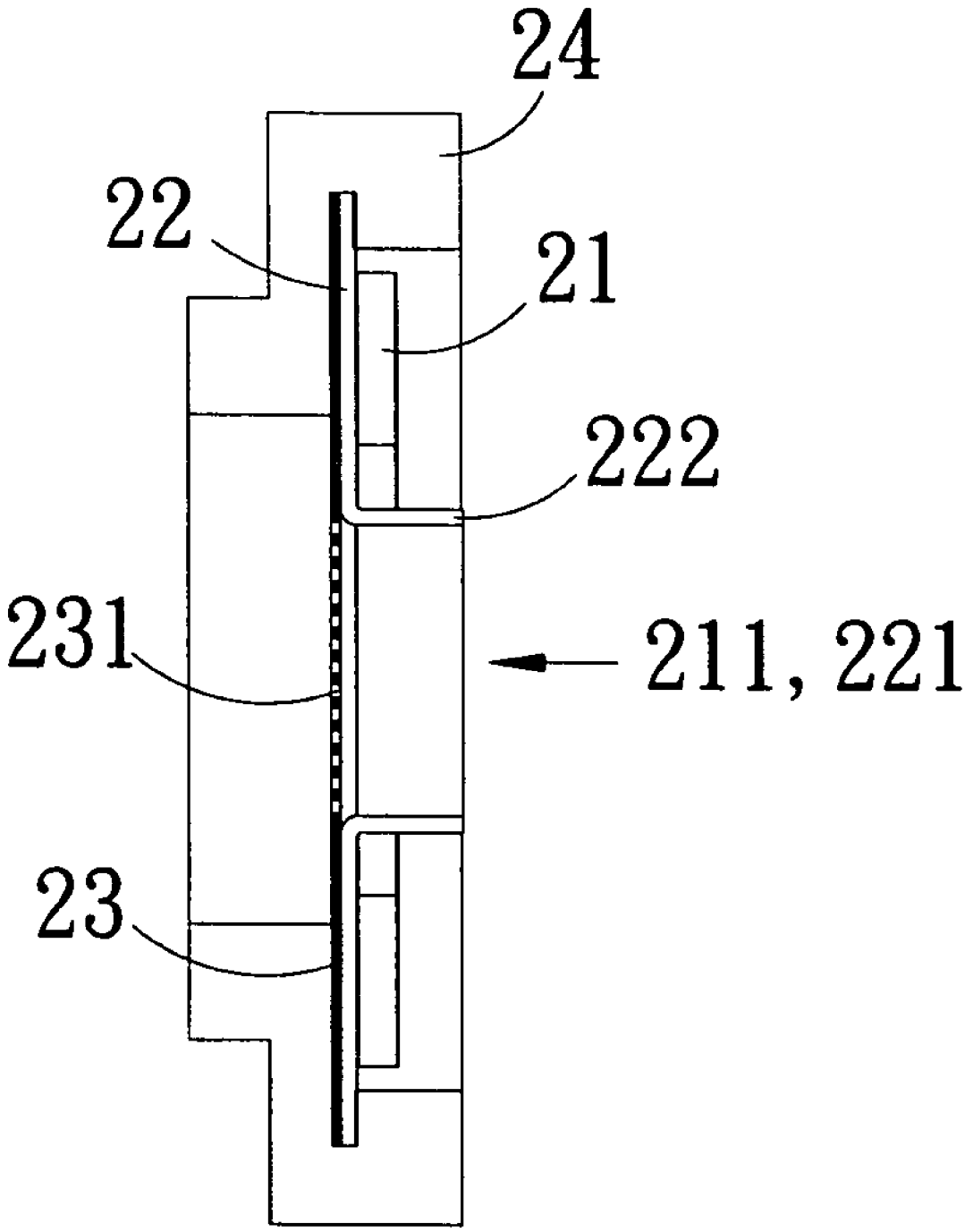
FIG. 3 is an assembly cross-section drawing of a droplet generation apparatus of the present invention.

Referring to FIG. 2 to FIG. 3, FIG. 2 is an exploded assembly drawing illustrating a droplet generation apparatus of the invention, and FIG. 3 is an assembly cross-section view illustrating a droplet generation apparatus. As shown in FIG. 2, the droplet generation apparatus 2 is applied to an atomizer, and comprises a vibratable member 21, a connection member 22, a nozzle disc 23 and a housing 24. The vibratable member 21 has a first through hole 211, and the nozzle disc 23 has a plurality of apertures 231 facing the first through hole 211. The connection member 22 is disposed between the vibratable member 21 and the nozzle disc 23, and has a second through hole 221 corresponding to the first through hole 211, and is combined with the vibratable member 21 and the nozzle disc 23. The housing 24 covers up the vibratable member 21, the connection member 22 and the nozzle disc 23. Moreover, the inside of the second through hole 221 of the connection member 22 further has an extension wall 222 disposed into the first through hole 211 of the vibratable member 21.

Figure 4:
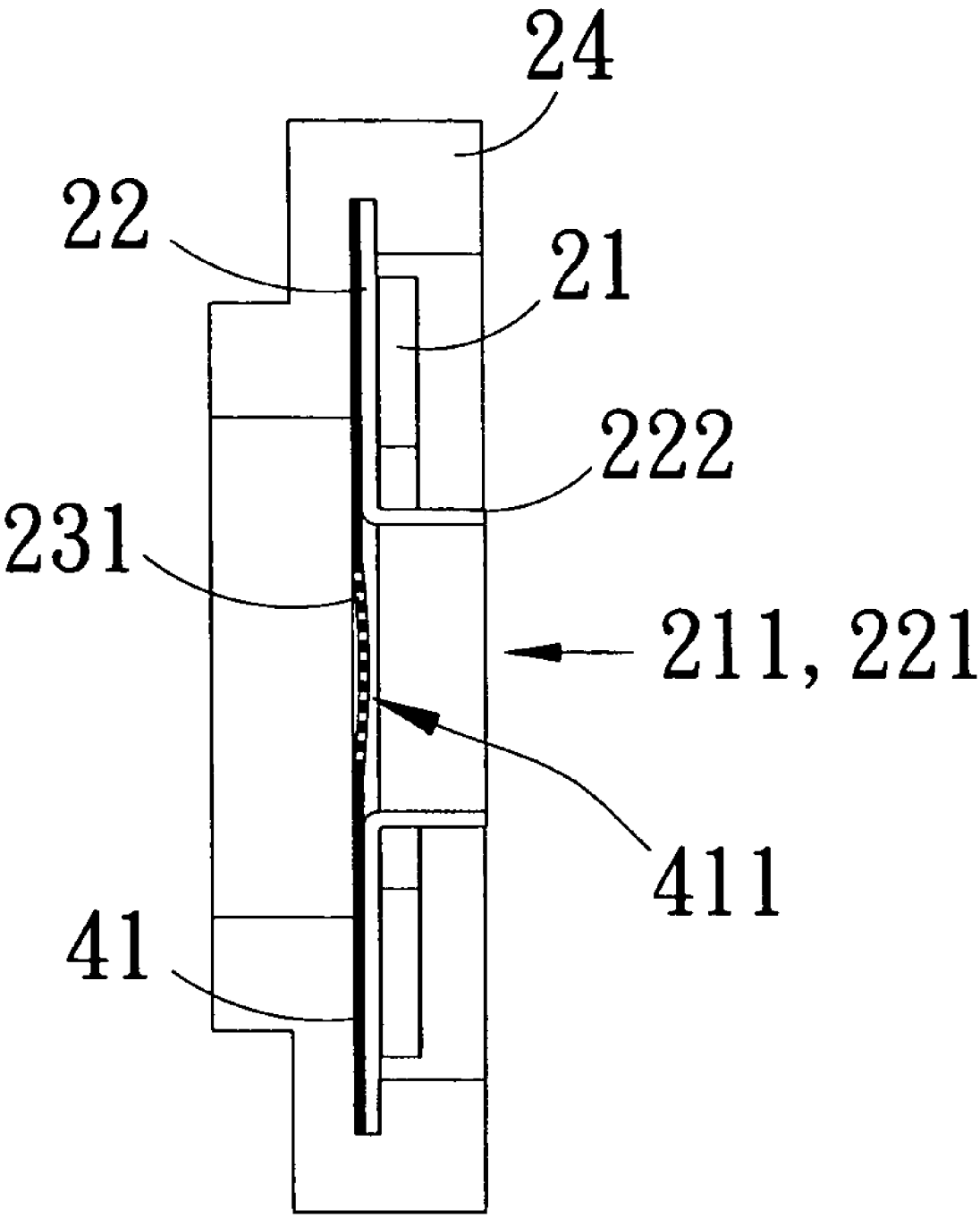
FIG. 4 is an assembly cross-section drawing of another droplet generation apparatus of the present invention.

Referring to FIG. 4 for the assembly cross-section view of another droplet generation apparatus of the invention, the droplet generation apparatus 4 is applied to an atomizer, and comprises the vibratable member 21, the connection member 22, a nozzle disc 41 and the housing 24. The vibratable member 21 has the first through hole 211, and the nozzle disc 41 has a plurality of apertures 231 facing the first through hole 211. The connection member 22 is disposed between the vibratable member 21 and the nozzle disc 41, and has the second through hole 221 corresponding to the first through hole 211, and is combined with the vibratable member 21 and the nozzle disc 41. The housing 24 covers up the vibratable member 21, the connection member 22 and the nozzle disc 41. Furthermore, the inside of the second through hole 221 of the connection member 22 has an extension wall 222 disposed into the first through hole 211 of the vibratable member 21. A plane of the nozzle disc 41 forms a protrusion-shaped 411 that has the aforesaid apertures 231. The protrusion-shaped 411 faces the first through hole 211 and the second through hole 221.

Figure 5:
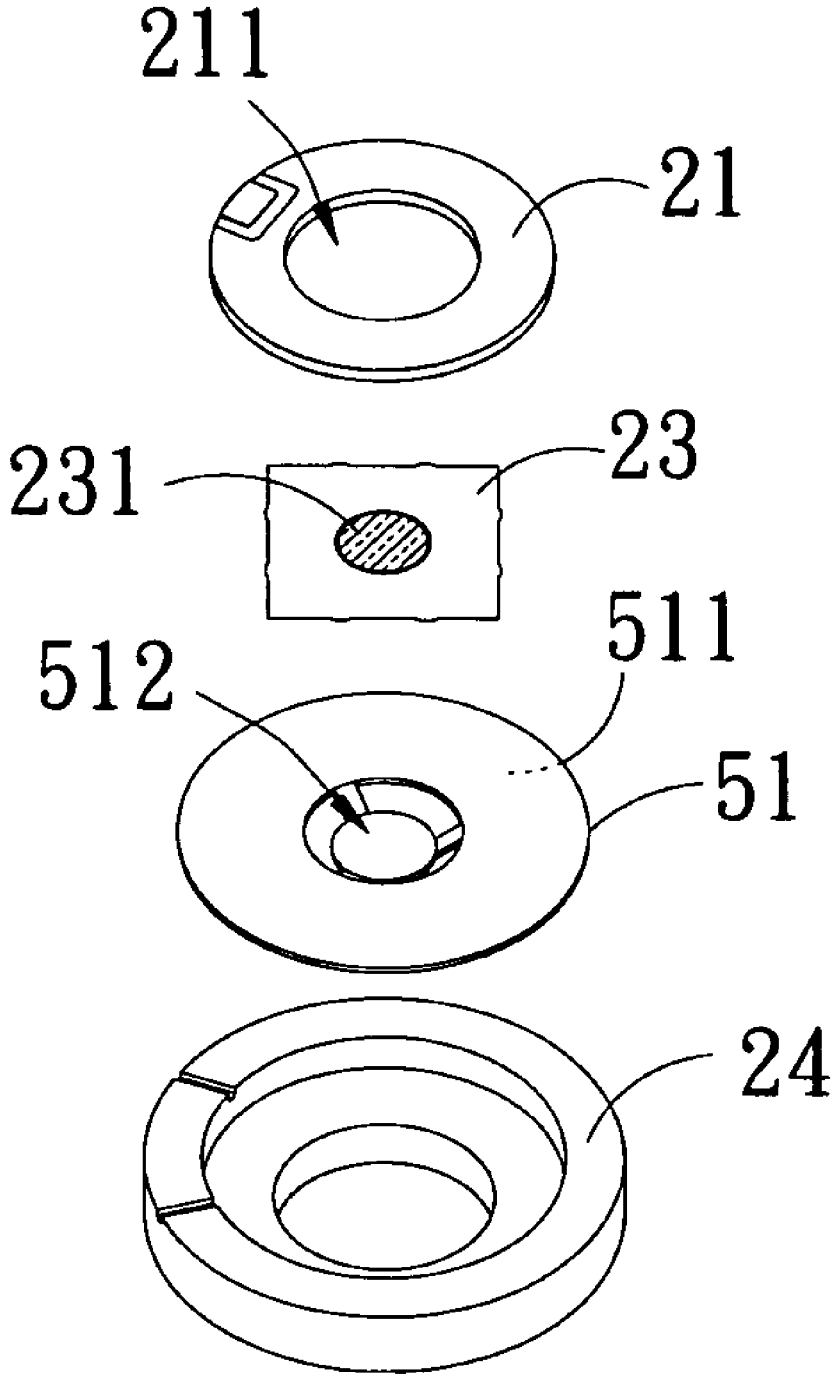
FIG. 5 is an exploded assembly drawing of another droplet generation apparatus of the present invention.
Figure 6:
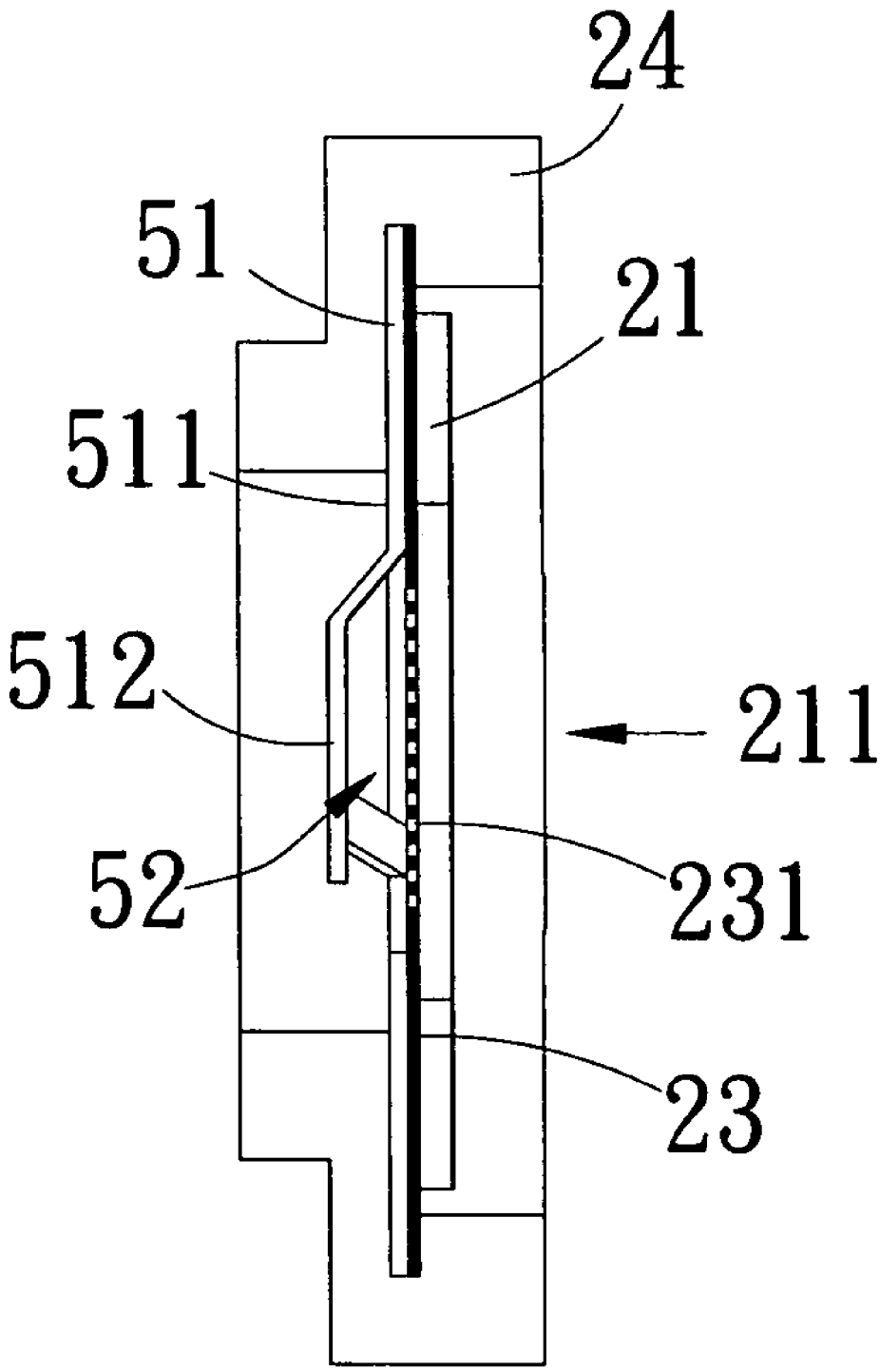
FIG. 6 is an assembly cross-section drawing of another droplet generation apparatus of the present invention.

Referring to FIG. 5 and FIG. 6, FIG. 5 is an exploded assembly drawing of another droplet generation apparatus of the invention, and FIG. 6 is an assembly cross-section drawing of another droplet generation apparatus. As shown in FIG. 5, the droplet generation apparatus 5 is applied to an atomizer, and comprises the vibratable member 21, the nozzle disc 23, a fastening plate 51 and the housing 24. The vibratable member 21 has the first through hole 211, and is combined with the fastening plate 51. The nozzle disc 23 is disposed between vibratable member 21 and the fastening plate 51, and has the plurality of apertures 231 facing the first through hole 211. The housing 24 covers up the vibratable member 21, the fastening plate 51 and the nozzle disc 23. Moreover, the fastening plate 51 forms a hollow protrusion 512 from a plane 511 which is behind the nozzle disc 23. When the fastening plate 51 is combined with the nozzle disc 23, an accommodation space 52 is formed by the hollow protrusion 512 and the nozzle disc 23.

Figure 7:
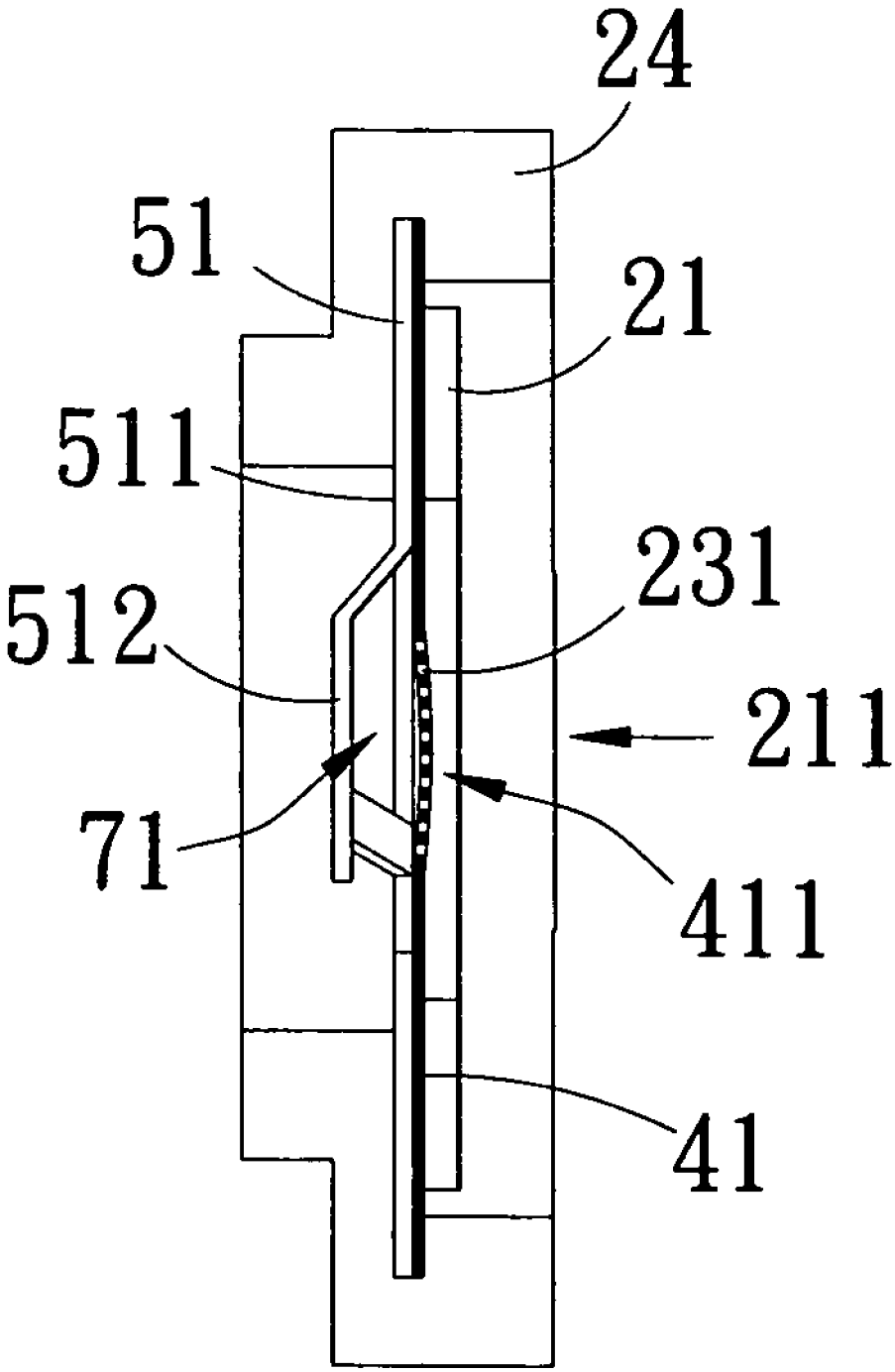
FIG. 7 is an assembly cross-section drawing of another droplet generation apparatus of the present invention.

Referring to FIG. 7 for an assembly cross-section drawing of another droplet generation apparatus of the invention is illustrated. The droplet generation apparatus 7 is applied to an atomizer, and comprises the vibratable member 21, the nozzle disc 41, the fastening plate 51 and the housing 24. The vibratable member 21 has the first through hole 211, and is combined with the fastening plate 51. The nozzle disc 41 is disposed between the vibratable 21 and the fastening plate 51, and has the plurality of apertures 231 facing the first through hole 211. The housing 23 covers up the viratable member 21, the fastening plate 51 and the nozzle disc 41. Moreover, the fastening plate 51 forms a hollow protrusion 512 from a plane 511 which is behind the nozzle disc 23. When the fastening plate 51 is combined with the nozzle disc 41, the plane of the nozzle disc 41 then forms a protrusion-shaped 411 that has the apertures 231. The protrusion-shaped 411 faces the first through hole 211 and the second through hole 221. The protrusion-shaped 411 and the hollow protrusion 512 form an accommodation space 71.

Referring to FIG. 5 to FIG. 7, the size of the nozzle disc 23 or 41 is generally equivalent to the vibratable member 21 and the fastening plate 51 or smaller than the vibratable member 21 or the fastening plate 51. When the size of the nozzle disc 23 is smaller than the vibratable member 21 and the fastening plate 51, the vibratable member 21 is directly combined with the fastening plate 51 to allow the nozzle disc 23 to be disposed between the vibratable member 21 and the fastening plate 51.

Figure 8:
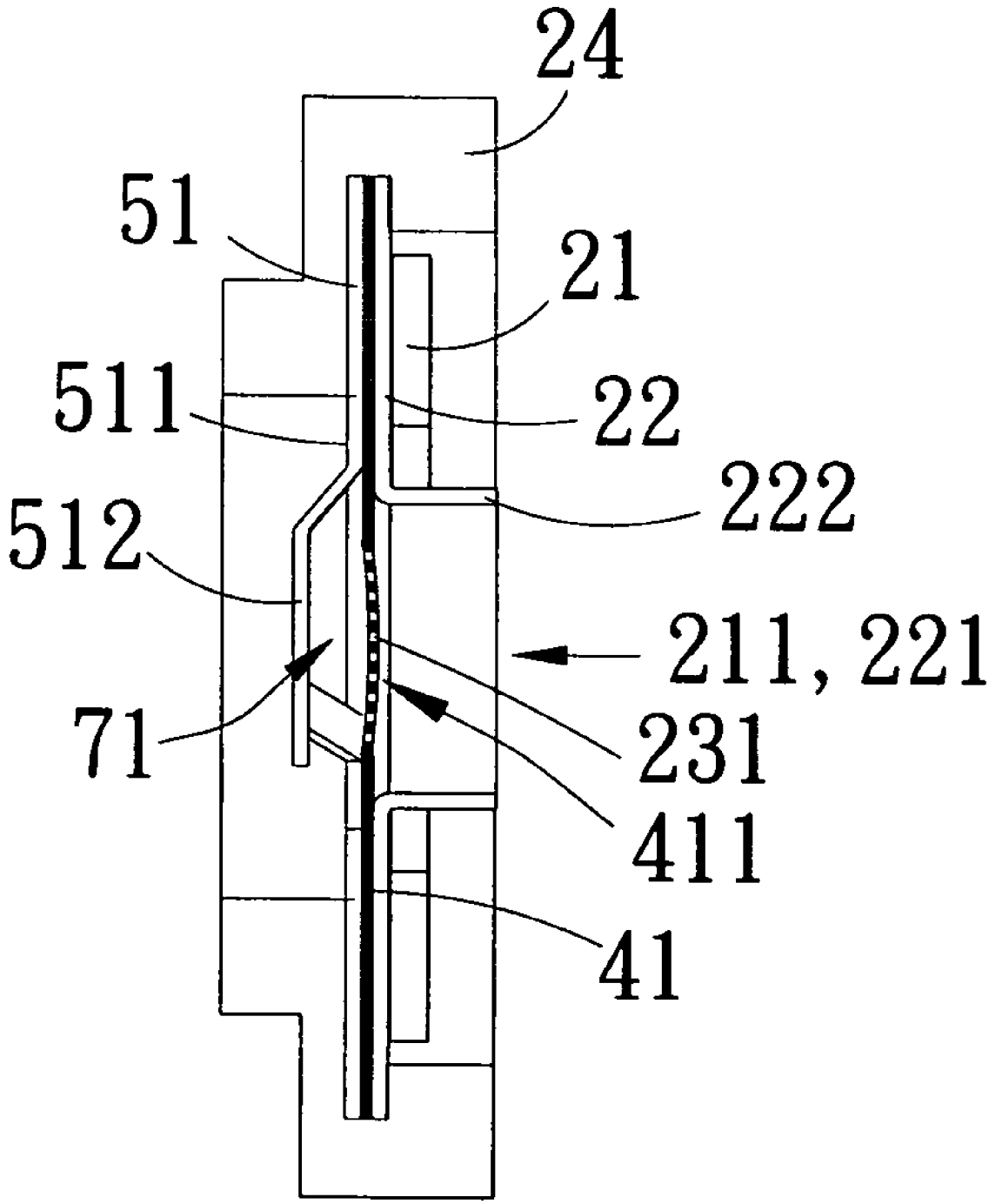
FIG. 8 is an assembly cross-section drawing of another droplet generation apparatus of the present invention.

Referring to FIG. 8 for an assembly cross-section drawing of another droplet generation apparatus of the invention is illustrated. The droplet generation apparatus 8 is applied to an atomizer, and comprises the vibratable member 21, the connection member 22, the nozzle disc 41, the fastening plate 51 and the housing 24. The vibratable member 21 has the first through hole 211. The connection member 22 has the second through hole 221 corresponding to the first through hole 211, and is combined with the vibratable member 21. The nozzle disc 41 has a plurality of apertures 231 facing the first through hole 211 and the second through hole 221, and is combined with the connection member 22. The fastening plate 51 is combined with the nozzle disc 41. The housing 24 covers up the vibratable member 21, the connection member 22, the nozzle disc 41 and the fastening plate 51. Moreover, the inside of the second through hole 221 of the connection member 22 has an extension wall 222 that is disposed into the first through hole 211 of the vibratable member 21. A plane of the nozzle disc 41 forms a protrusion-shaped 411 that has the apertures 231. The protrusion-shaped 411 faces the first through hole 211 and the second through hole 221. The fastening plate 51 forms a hollow protrusion 512 from a plane 511 which is behind the nozzle disc 23. When the fastening plate 51 is combined with the nozzle disc 41, an accommodation space 71 is formed by the protrusion-shaped 411 of the nozzle disc 41 and the hollow protrusion 512 of the fastening plate 51.

In FIG. 8, the size of the nozzle disc 41 is equivalent to the connection member 22 and the fastening plate 51 or smaller than the connection member 22 and the fastening plate 51. When the size of the nozzle disc 41 is smaller than the connection member 22 and the fastening plate 51, the connection member 22 is directly combined with the fastening plate 51 to allow the nozzle disc 41 to be disposed between the connection member 22 and the fastening plate 51.

Accordingly, the vibratable member of the droplet generation apparatus of the invention is preferably a piezoelectric member. The housing is preferably an o-shaped ring. A jelly-like substance is further filled between the extension wall of the connection member and the first through hole.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A droplet generation apparatus, applicable for a nebulizer, the droplet generation apparatus comprising:

a vibratable member having a first through hole;

a nozzle disc having a plurality of apertures facing the first through hole;

a connection member disposed between the vibratable member and the nozzle disc, and having a second through hole corresponding to the first through hole; and a housing for covering up the combination of the vibratable member, the nozzle disc and the connection member;

said connection member having an extension wall further extending from an inner periphery of the second through hole of the connection member and is positioned in the first through hole of the vibratable member.

2. The droplet generation apparatus of claim 1, wherein the vibratable member includes a piezoelectric member.

3. The droplet generation apparatus of claim 1, wherein a jelly-like substance is further filled between the extension wall and the first through hole.

4. The droplet generation apparatus of claim 1, wherein a plane of the nozzle disc forms a protrusion-shaped that has the apertures, and the protrusion-shaped faces the first through hole and the second through hole.

5. The droplet generation apparatus of claim 1, wherein the housing includes an o-shaped ring.

6. The droplet generation apparatus of claim 1, wherein the droplet generation apparatus further comprises a fastening plate for combining with the nozzle disc, and the fastening plate forms a hollow protrusion from a plane behind the nozzle disc, and when the fastening plate is combined with the nozzle disc, an accommodation space is formed by the hollow protrusion and the nozzle disc.

7. The droplet generation apparatus of claim 6, wherein the fastening plate is further combined with the connection member.

8. A droplet generation apparatus, applicable for a nebulizer, and the droplet generation apparatus comprising:

a vibratable member having a first through hole;

a fastening plate combined with the vibratable member;

a nozzle disc disposed between the vibratable member and the fastening plate, and having a plurality of apertures facing the first through hole; and a housing for covering up the combination of the vibratable member, the nozzle disc and the fastening plate;

wherein the fastening plate includes a hollow protrusion from a plane behind the nozzle disc, whereby when the fastening plate is combined with the nozzle disc, an accommodation space is formed by the hollow protrusion and the nozzle disc.

9. The droplet generation apparatus of claim 8, wherein the vibratable member includes a piezoelectric member.

10. The droplet generation apparatus of claim 8, wherein a plane of the nozzle disc forms a protrusion-shaped that has the apertures, and the protrusion-shaped faces the first though hole.

11. The droplet generation apparatus of claim 8, wherein the housing includes an o-shaped ring.

12. The droplet generation apparatus of claim 8, wherein the droplet generation apparatus further comprises a connection member that is disposed between the vibratable member and the nozzle disc, and the connection member has a second through hole corresponding to the first through hole.

13. The droplet generation apparatus of claim 12, wherein an extension wall is extended from the inside of the second through hole of the connection member, and is disposed in the first through hole of the vibratable member.

14. The droplet generation apparatus of claim 12, wherein the fastening plate is combined with the connection member.

15. The droplet generation apparatus of claim 13, wherein a jelly-like substance is further filled between the extension wall and the first through hole.

16. A droplet generation apparatus, applicable for a nebulizer, the droplet generation apparatus comprising:

a vibratable member having a first through hole;

a nozzle disc having a plurality of apertures facing the first through hole;

a connection member disposed between the vibratable member and the nozzle disc, and having a second through hole corresponding to the first through hole; and a housing for covering up the combination of the vibratable member, the nozzle disc and the connection member;

wherein the droplet generation apparatus further comprises a fastening plate for combining with the nozzle disc, and the fastening plate forms a hollow protrusion from a plane behind the nozzle disc, and when the fastening plate is combined with the nozzle disc, an accommodation space is formed by the hollow protrusion and the nozzle disc.

17. The droplet generation apparatus of claim 16, wherein the vibratable member includes a piezoelectric member.

18. The droplet generation apparatus of claim 16, wherein an extension wall is further extended from the inside of the second through hole of the connection member, and is disposed in the first through hole of the vibratable member.

19. The droplet generation apparatus of claim 18, wherein a jelly-like substance is further filled between the extension wall and the first through hole.

20. The droplet generation apparatus of claim 16, wherein a plane of the nozzle disc forms a protrusion-shaped that has the apertures, and the protrusion-shaped faces the first through hole and the second through hole.

21. The droplet generation apparatus of claim 16, wherein the housing includes an o-shaped ring.

22. The droplet generation apparatus of claim 16, wherein the fastening plate is further combined with the connection member.

23. A droplet generation apparatus, applicable for a nebulizer, and the droplet generation apparatus comprising:

a vibratable member having a first through hole;

a fastening plate combined with the vibratable member;

a nozzle disc disposed between the vibratable member and the fastening plate, and having a plurality of apertures facing the first through hole; and a housing for covering up the combination of the vibratable member, the nozzle disc and the fastening plate;

wherein the droplet generation apparatus further comprises a connection member that is disposed between the vibratable member and the nozzle disc, and the connection member has a second through hole corresponding to the first through hole.

24. The droplet generation apparatus of claim 23, wherein the vibratable member includes a piezoelectric member.

25. The droplet generation apparatus of claim 23, wherein a plane of the nozzle disc forms a protrusion-shaped that has the apertures, and the protrusion-shaped faces the first through hole.

26. The droplet generation apparatus of claim 23, wherein the housing includes an o-shaped ring.

27. The droplet generation apparatus of claim 23, wherein the fastening plate forms a hollow protrusion from a plane behind the nozzle disc, and when the fastening plate is combined with the nozzle disc, an accommodation space is formed by the hollow protrusion and the nozzle disc.

28. The droplet generation apparatus of claim 23, wherein an extension wall is extended from the inside of the second through hole of the connection member, and is disposed in the first through hole of the vibratable member.

29. The droplet generation apparatus of claim 23, wherein the fastening plate is combined with the connection member.

30. The droplet generation apparatus of claim 28, wherein a jelly-like substance is further filled between the extension wall and the first through hole.

* * * * *